US005081468A

United States Patent [19]

Williams

[11] Patent Number: 5,081,468

[45] Date of Patent: Jan. 14, 1992

[54] FREQUENCY AGILE TRIANGULAR ANTENNA

[75] Inventor: Austin M. Williams, Diamond Bar, Calif.

[73] Assignee: Hughes Aircraft Company, Los Angeles, Calif.

[21] Appl. No.: 537,381

[22] Filed: Jun. 13, 1990

[51] Int. Cl.[5] ..... H01Q 1/36

[52] U.S. Cl. ..... 343/895; 343/876; 343/705

[58] Field of Search ..... 343/895, 876, 705, 708, 343/745, 750

[56] References Cited

U.S. PATENT DOCUMENTS

| | | | |
|---|---|---|---|
| 3,671,970 | 6/1972 | Layton | 343/895 |
| 3,988,737 | 10/1976 | Middlemark | 343/895 |
| 4,656,483 | 4/1987 | Jaquet | 343/740 |
| 4,924,238 | 5/1990 | Ploussios | 343/895 |
| 4,939,525 | 7/1990 | Brunner | 343/895 |

*Primary Examiner*—Michael C. Wimer
*Assistant Examiner*—Hoanganh Le
*Attorney, Agent, or Firm*—W. K. Denson-Low

[57] ABSTRACT

An antenna comprising a plurality of sections, each section comprising first and second coil forms forming a triangle with a ground plane and having a continuous ribbon cable and a multiconductor cable wound in helical fashion about the coil forms. Selected conductors of the multiconductor cable are terminated at selected sections and connected to PIN switching diodes to switch selected amounts of inductance out of the circuit, thereby providing multiple selectable frequencies of operation for the antenna.

7 Claims, 4 Drawing Sheets

FREQUENCY AGILE TRIANGULAR ANTENNA

BACKGROUND OF THE INVENTION

1. Field of the Invention

The subject invention relates to antennas and, more particularly, to a triangular section, helically-wound antenna tuned through use of PIN diodes.

2. Description of Related Art

In the prior art, there has existed a need for an improved antenna, particularly suitable for helicopter applications. Such applications present various design requirements such as the need to minimize rotor amplitude modulation arising from helicopter blades, as well as the desirability to accommodate frequency hopping operation.

In prior art antenna applications, the so-called "tranline" or "trombone" antenna has typically been used. This antenna is a shortened transmission line mounted external to the helicopter via an external antenna-coupler. It has not appeared practical to use existing designs of the tranline in frequency hopping applications.

SUMMARY OF THE INVENTION

Accordingly, it is an object of the invention to provide an improved antenna;

It is another object of the invention to provide an improved antenna for helicopter applications;

It is another object of the invention to provide a helicopter antenna less susceptible to helicopter rotor amplitude-modulation; and It is still another object of the invention to provide an antenna for helicopters and other applications which is capable of frequency hopping.

The invention provides a triangular cross-section, helically-wound antenna, which minimizes helicopter rotor amplitude modulation. The triangular cross-section is preferably achieved by disposing a series of coil forms in triangular relation with a ground plane and serially winding a flat continuous conductor around the coil forms.

According to a feature of the invention, the antenna is tuned by means of shorting adjacent mutually-coupled coils using PIN diodes and PIN diode switched loading capacitance shunt fed through a wideband 9:1 impedance-transforming balun. The PIN diode switching feature provides the rapid frequency selection necessary for frequency hopping applications of the antenna.

BRIEF DESCRIPTION OF THE DRAWINGS

The just-summarized invention will now be described in detail in conjunction with the drawings, of which.

DESCRIPTION OF THE PREFERRED EMBODIMENTS

The following description is provided to enable any person skilled in the art to make and use the invention and sets forth the best mode contemplated by the inventor of carrying out his invention. Various modifications, however, will remain readily apparent to those skilled in the arts since the generic principles of the present invention have been defined herein specifically to provide a helical triangular antenna suitable for helicopter application at selectable frequencies.

Figure 1:
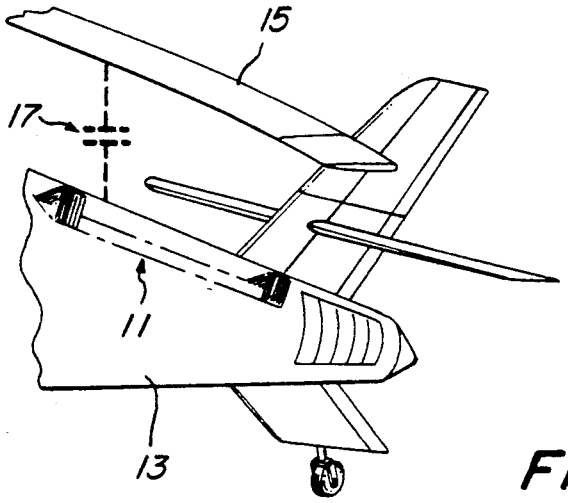
FIG. 1 is a perspective pictorial view illustrating an antenna according to the preferred embodiment.

FIG. 1 illustrates a triangular cross-section helix antenna 11 located within a helicopter tail boom 13 beneath the rotor blade 15 of the helicopter. Preferably, the antenna 11 is oriented horizontally on the upper center line of the tail boom 13 and fanned into the structure for an aerodynamically clean profile. The switching and matching electronics are preferably co-located with the antenna 11, thus comprising an integral antenna and coupler. The surface beneath the antenna 11 is highly conductive to minimize losses and to maximize radiation toward the zenith for near-vertical-incidence-skywave (NVIS) propagation.

As indicated in FIG. 1, a distributed capacitance 17 arises between the rotor blade 15 and the triangular cross-section antenna 11. This capacitance varies as the blade 15 rotates, giving rise to a changing capacitance and resultant amplitude modulation of the radiated electromagnetic signal.

Figure 2:
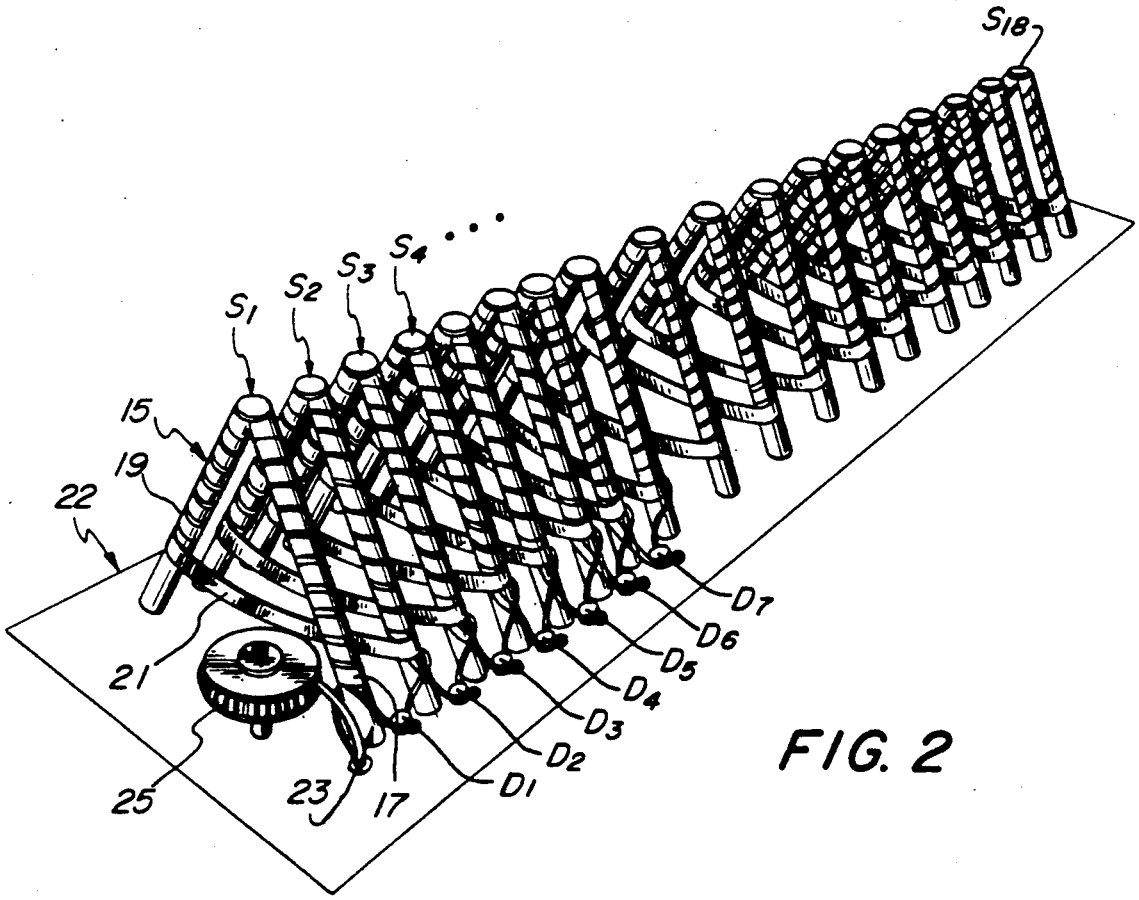
FIG. 2 is a perspective view illustrating an antenna according to the preferred embodiment.

FIG. 2 illustrates an antenna including a number of triangular sections $S_1$, $S_2$ . . . $S_{18}$ mounted on a ground plane 21. The first seven sections $S_1$ . . . $S_7$ are ferrite loaded, as further described in connection with FIG. 4. The ferrite-loaded sections $S_1$, $S_2$ . . . $S_7$, which supply most of the inductance of the antenna, are more closely spaced than the remaining air core sections $S_8$ . . . $S_{18}$.

Each triangular section $S_1$ . . . $S_{18}$ includes a right leg 17 and a left leg 19. The legs 17, 19 of each section $S_1$ . . . $S_{18}$ are equal in length, and each pair forms the same angle where they meet above the ground plane 22. The foot of each right leg 17 lies on a line parallel to a line on which lie the feet of each left leg 19.

Eighteen elements $S_1$ . . . $S_{18}$ have been employed in a prototype according to the preferred embodiment to provide inductive reactance commensurate with a loaded Q not exceeding 200 at 2 megaHertz. This Q gives a 3-dB bandwidth of about 10 kiloHertz. This bandwidth is about the minimum practical bandwidth for a nominal 3-kHz HF voice channel, with allowance for some tuning error.

As further shown in FIG. 2, a flat copper ribbon cable 21 is grounded at the foot 23 of the right leg 17 of the first triangular section $S_1$ and is wound upward around the right leg 17, then down around the left leg 19 of the section $S_1$, and then across to the right leg 17 of the second triangular section $S_2$. This serial winding of the continuous flat copper ribbon cable 21 up the right leg 17, down the left leg 19, and across to the right leg of the next triangular section continues down the entire linear array of triangular sections $S_2$ . . . $S_{18}$.

A flat 20-conductor cable 29 underlies the flat ribbon cable 21. The ribbon cable 21 may be 0.5 inch by 3 mil copper over two flat cables, each flat cable carrying 10 conductors of 28 AWG and comprising the cable 29. Such an implementation was employed in a prototype according to the preferred embodiment. However, other implementations may prove more desirable, such as a custom ribbon cable with integral ground plane and low $Z_o$ flat conductors. The number of flat conductors should decrease by one per section $S_1$, $S_2$ . . .

Figure 4:
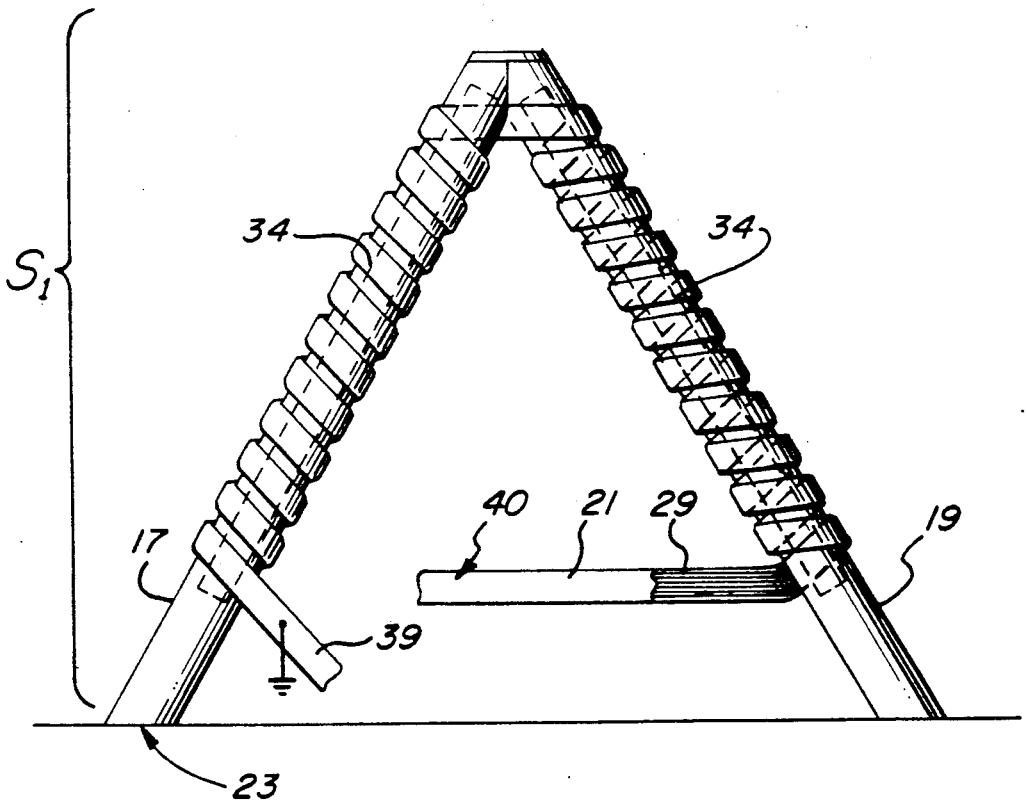
FIG. 4 is a front view of a portion of the anntenna of FIG. 3.

PIN diodes $D_1$, $D_2$, $D_3$ . . . $D_7$ are located between each pair of right legs 17. The first PIN diode $D_1$ has one terminal connected to three conductors of the flat 20-conductor cable 29 at the base of the right leg 17 of the second triangular section $S_2$. The second terminal of the first PIN diode $D_1$ is connected to the ground at the foot 23 of the right leg 17 of the first triangular section $S_1$. When activated, the first PIN diode $D_1$ shorts three conductors of the cable 29 on the right leg 17 of the second section $S_2$ to the grounded copper ribbon 39 (FIG. 4). The remaining PIN diodes $D_2$ . . . $D_7$ are similarly connected to short selected conductors of the flat 20-conductor cable 29 from one section $S_3$, $S_4$ . . . $S_7$ to the copper ribbon 21 of a respective preceding section $S_2$, $S_3$ . . . $S_6$, as shown more explicitly in the circuit schematic of FIG. 5. Three conductors of the flat 20-conductor cable 29 are shorted at each of the first six triangular sections $S_1$ . . . $S_6$, and two are shorted at the seventh section $S_7$. Accordingly, these sections $S_1$, $S_2$, $S_3$, $S_4$, $S_5$, $S_6$, $S_7$ have, respectively, 20, 17, 14, 11, 8, 5, and 2 active conductors of the cable 29 wrapped thereon. In this manner, various triangular sections $S_1$ . . . $S_6$ may be switched in and out to vary the inductance of the antenna. The change in inductance with switching is a function of the coupling coefficient of the conductors of the flat 20-conductor cable 29 to the flat ribbon cable 21.

Additionally shown in FIG. 2 is a balun or auto transformer 25, which receives the RF input and provides it to the first section $S_1$. The balun 25 provides a 9:1 impedance transformation required for impedance matching.

Figure 3:
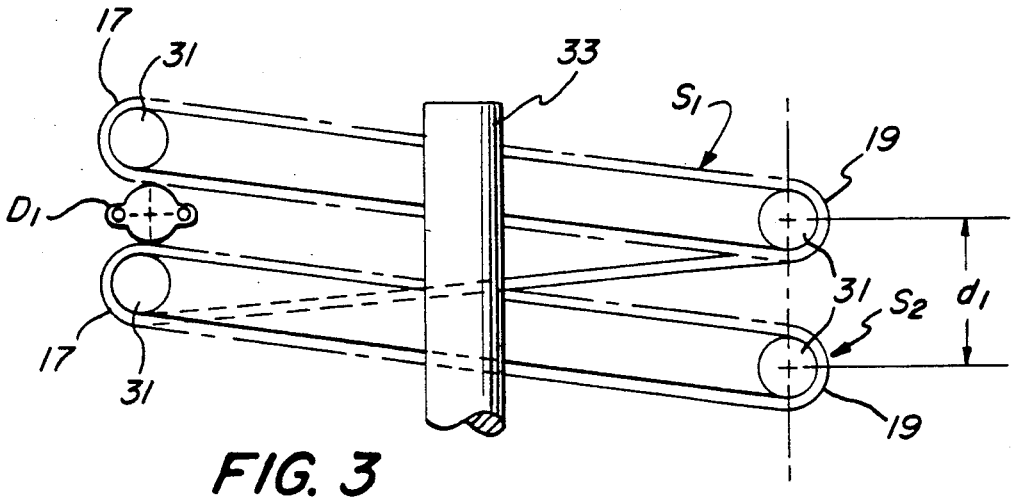
FIG. 3 is a top view of a section of the antenna of FIG. 2.

FIGS. 3 and 4 show the first two sections $S_1$, $S_2$ in more detail. As shown, the legs 17, 19 are formed of cylindrical coil forms 31, which may, for example, comprise G-10 fiberglass cylinders, which are 0.75 inches in diameter. A fiberglass structural support 33 may be provided for added stability and strength. The distance $d_1$ in FIG. 3 (turn to turn spacing) may be, for example, 2.25 inches.

FIG. 4 shows ferrite rods 37 in phantom. These rods 37 are inserted into each of the coil forms 31 of the first six triangular sections $S_1$ . . . $S_6$. These rods 37 achieve increased inductance without a serious weight penalty. The benefits of such ferrite-loaded solenoidal coils for both receive and transmit are well-established. The gain of a transmitting coil increases as a function of the diameter and the percentage of the core area filled with ferrite material. A conventional large diameter coil with ferrite loading would have excessive weight. Ferrite loading of the individual coils permits the achievement of higher inductance per major helix turn without excessive weight penalty.

As shown in FIG. 4, the outer copper ribbon conductor 21 is wound around the coil form 31 in helical fashion with uniform spacing between the turns, as is the cable 29 supplying the underlying 20 conductor wires. The turns begin at a selected distance above the ground plane 22, for example, 1.5 inches. The lead end 39 of the ribbon cable 21 is grounded, while the crossover portion 40 of the cable 21 crosses over to begin winding about the right leg 17 of the second triangular section $S_2$. The crossover portion 40 is twisted as it crosses over to achieve proper winding about the next right leg 17. Thus, in FIG. 4, one sees the multiconductor cable 29 coming off the left leg 19 and twisted over to present the flat ribbon cable 21. The inductor formed by the outer ribbon cable 21 and right leg 17 of section $S_1$ may be referred to as $L_1$, while that formed by the outer ribbon cable 21 and the left leg 19 may be referred to as $L_2$.

Figure 5:
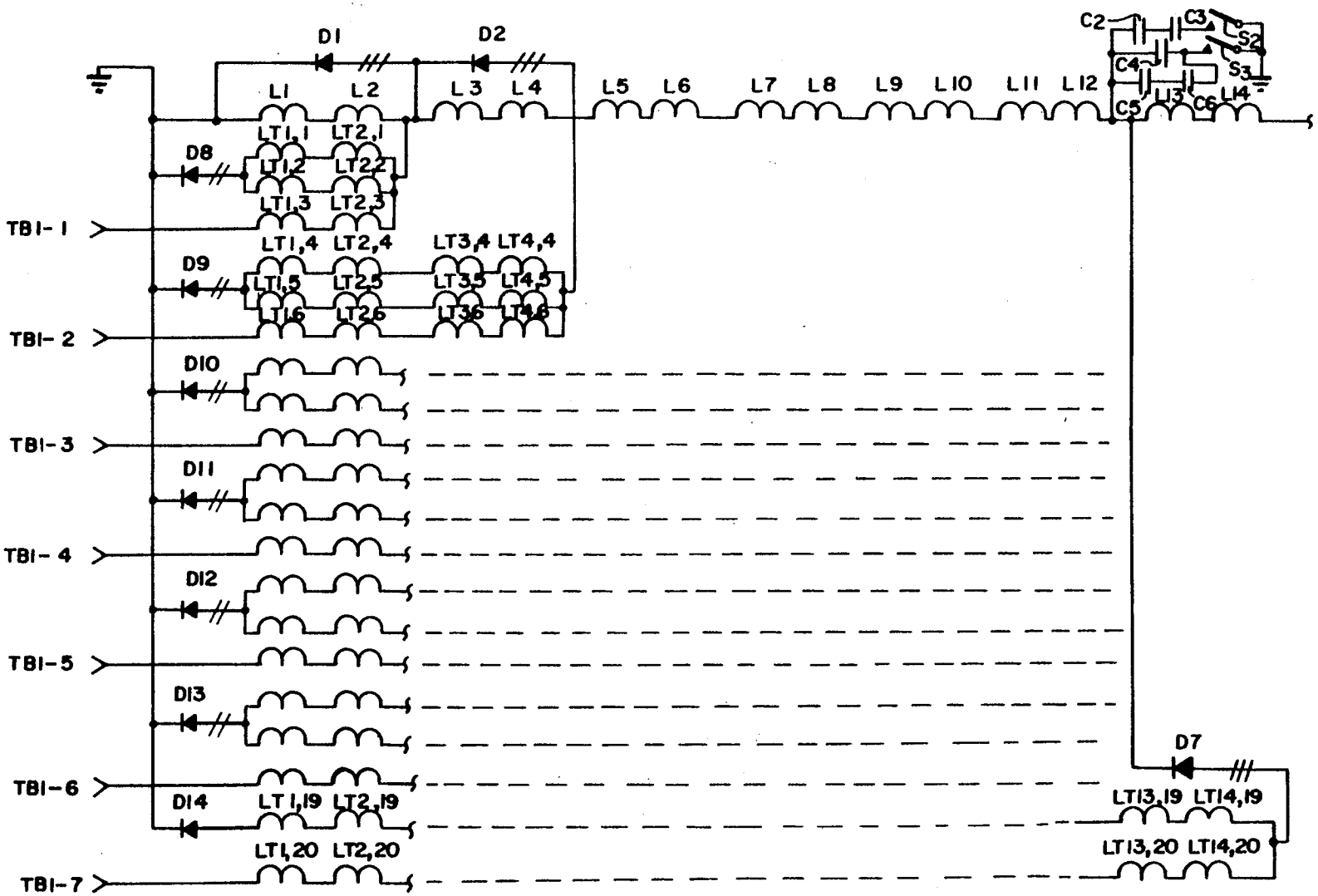
FIGS. 5 and 6 form a circuit schematic further illustrative of the structure of the preferred embodiment.
Figure 6:
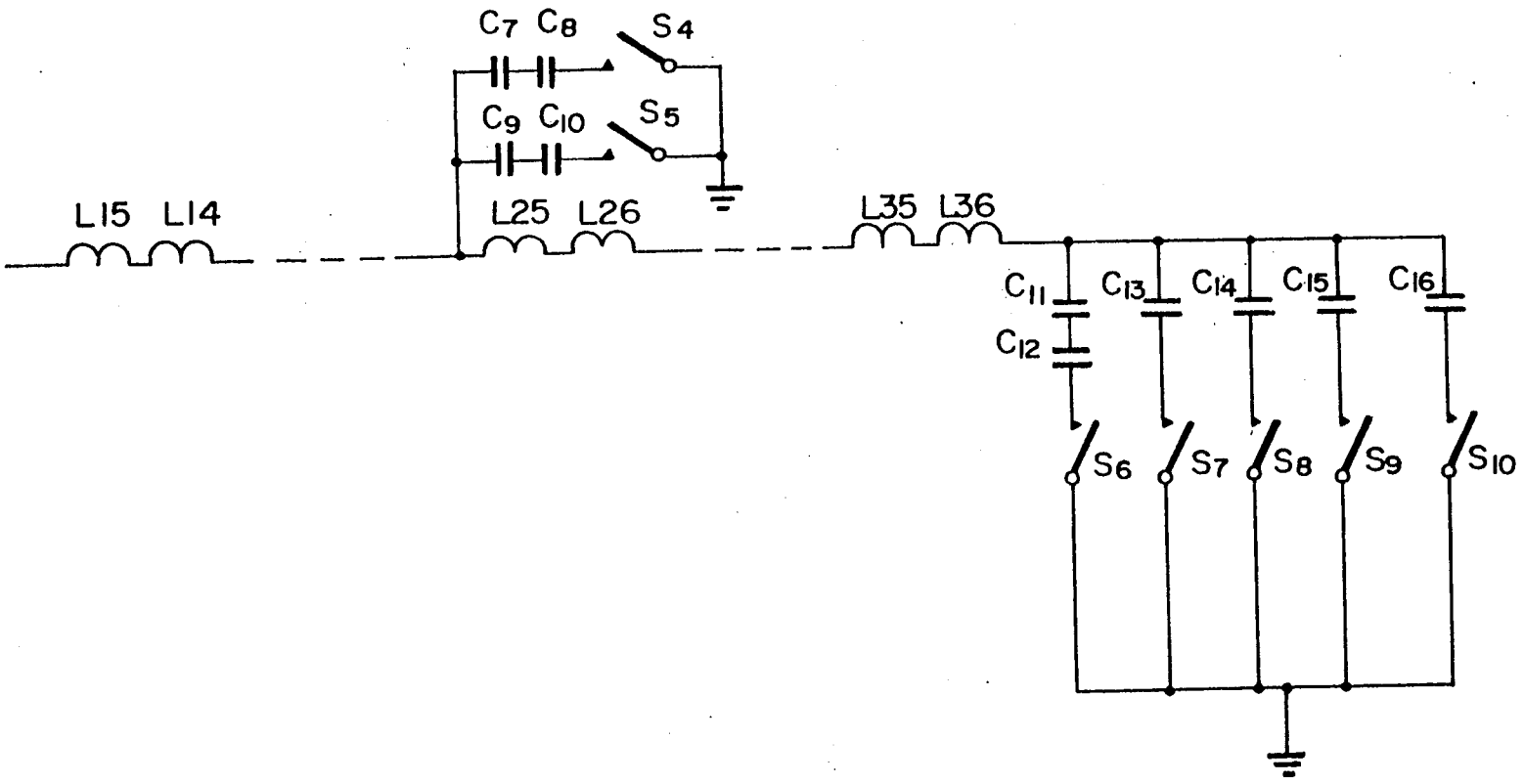

The schematic of FIGS. 5 and 6 is further illustrative of system interconnection and operation. Each winding of the outer ribbon about a right leg 17 corresponds to an element (inductance) labelled $L_1$, $L_3$, $L_5$ . . . $L_{35}$, while each winding of the outer ribbon about a left leg 19 corresponds to an element labelled $L_2$, $L_4$, $L_6$ . . . $L_{36}$. The RF input to the circuit is supplied to the balun 25, whose output line 41 is connected to the copper ribbon cable at a point between elements $L_2$ and $L_3$, that is, between the right leg 17 of the first triangular section $S_1$ and the left leg of the second triangular section $S_2$. Ferrite loading of windings $L_1$ through $L_{12}$ is indicated.

Further in FIG. 5, the turns of the 20-conductor cable about the respective legs, e.g., 17, 19, of the sections $S_1$ . . . $S_{18}$ are labeled $LT_{x,yz}$, where x is a column indicator and yz is a row indicator. Hash marks across a wire, e.g., at 51, 52, indicate multiple wires. Thus, for example, PIN diode $D_8$ has the turns $LT_{1,1}$, $LT_{1,2}$ of two conductors of the multiconductor cable connected to its anode, wrapped from there around inductances $L_1$ and $L_2$ and connected to the anode of the PIN switching diode $D_1$. The third conductor of the 20-conductor cable which forms coils $LT_{1,3}$ and $LT_{2,3}$ is connected to a first switching control point TB-1 of seven switch control points TB-1 . . . TB1-7. The anode of PIN diode $D_1$ is connected to the far end of $LT_{2,1}$, $LT_{2,2}$, and $LT_{2,3}$. Thus, as indicated by three hash marks 57, there are three conductors of the multiconductor cable connected to the anode of the PIN diode $D_1$. As shown in FIGS. 5 and 6, this structure is replicated for each of the seven sections $S_1$ . . . $S_7$ and each of the PIN diodes $D_1$ . . . $D_6$. As mentioned above, diode $D_7$ has only two conductors attached to its anode, namely those associated with turns $LT_{14,19}$ and $LT_{14,20}$.

In operation, when a switching voltage is applied to one of the switch terminals TB1-1 . . . TB1-7, a respective diode $D_1$ . . . $D_7$ is switched on, removing inductance from the circuit. Tying together of conductors such as indicated by hash marks, e.g., 51, 52 provides a lower characteristic impedance. The PIN diodes $D_8$, $D_9$ . . . $D_{14}$ function to provide a low impedance path to ground when the corresponding windings, e.g., $L_1$, $L_2$, are shunted by a PIN diode in an "ON" (low impedance) state. For example, when forward current is flowing in $D_1$, then forward current flows in $D_8$ also. The effective inductance in this condition is thus the leakage inductance between $L_1$ and $L_2$ in series and the inductively coupled inductors $LT_{1,1}$ and $LT_{2,1}$ in series, paralleled by the series combination of $LT_{1,2}$ and $LT_{2,2}$. The inductance of $LT_{1,3}$ and $LT_{2,3}$ does not contribute significantly, since the driving point (source) impedance at TB1-1 is relatively high in comparison to the PIN diode "ON" resistance, typically less than 0.5 ohm. Typically, a current of 200 ma flows through terminal TB1-1 when diodes $D_1$ and $D_8$ are "ON," whereas a negative potential of 1000 volts is applied to TB1-1 when $D_1$ and $D_8$ are "OFF" (reverse-biased).

The circuit of FIGS. 5 and 6 also employs a number of tuning capacitors $C_1$ . . . $C_{16}$ and switches, preferably PIN diodes $S_1$ . . . $S_{10}$ for switching various combinations of the capacitors $C_1$ . . . $C_{16}$ in and out of the circuits. Exemplary values for the capacitors in the implementation under discussion are:

TABLE I

| | | | |
|---|---|---|---|
| $C_1$ | 10 pf | $C_9$ | 180 pf |
| $C_2$ | 33 pf | $C_{10}$ | 180 pf |
| $C_3$ | 33 pf | $C_{11}$ | 33 pf |

TABLE I-continued

| | | | |
|---|---|---|---|
| $C_4$ | 62 pf | $C_{12}$ | 33 pf |
| $C_5$ | 33 pf | $C_{13}$ | 25 pf |
| $C_6$ | 33 pf | $C_{14}$ | 50 pf |
| $C_7$ | 18 pf | $C_{15}$ | 50 pf |
| $C_8$ | 18 pf | $C_{16}$ | 3 × 62 pf |

With the prototype unit of FIG. 5, six switchable frequencies have been obtained based on the tuning data in the following table:

TABLE II

| FREQUENCY | D1 | D2 | D3 | D4 | D5 | D6 | D7 |
|---|---|---|---|---|---|---|---|
| 2.110 MHz | OFF | OFF | OFF | OFF | OFF | ON | OFF |
| 3.160 | OFF | ON | ON | ON | ON | ON | OFF |
| 6.195 | OFF | OFF | OFF | ON | ON | ON | OFF |
| 8.190 | OFF | OFF | OFF | OFF | OFF | OFF | ON |
| 12.225 | OFF | OFF | OFF | OFF | OFF | OFF | OFF |
| 22.860 | OFF | OFF | OFF | OFF | OFF | OFF | OFF |

| FREQUENCY | S1 | S2 | S3 | S4 | S5 | S6 | S7 | S8 | S9 | S10 |
|---|---|---|---|---|---|---|---|---|---|---|
| 2.110 MHz | 0 | 0 | 0 | 0 | 0 | 0 | 0 | CL | 0 | 0 |
| 3.160 | 0 | 0 | 0 | 0 | 0 | 0 | 0 | 0 | 0 | 0 |
| 6.195 | 0 | 0 | CL | 0 | 0 | CL | CL | 0 | 0 | CL |
| 8.190 | CL | 0 | CL | 0 | CL | CL | 0 | 0 | 0 | 0 |
| 12.225 | 0 | 0 | 0 | 0 | 0 | CL | CL | CL | CL | 0 |
| 22.860 | 0 | 0 | 0 | 0 | 0 | 0 | 0 | 0 | 0 | 0 |

As may be appreciated, the number of switchable frequencies may be expanded by adding more conductors to switch more PIN diodes. The provision of seven PIN diodes $D_1 \ldots D_7$ was selected to simplify prototyping.

According to the preferred embodiment, the use of shunt feeding facilitates direct grounding of the helix at the highest RF current point to minimize losses. Anticipated efficiency is on the order of 2% to 3% at 2 MHz for the disclosed embodiment, which is far better than proposed inductive loop/external coupler combinations. The antenna will operate at essentially quarter wave resonance at the low frequencies; half wave at the intermediate HF region, and essentially low-Q traveling wave at the high end. Frequency coverage may be extended from 2 to 30 MHz, although 1.5 MHz is possible at reduced efficiency.

An antenna constructed according to the invention has a number of advantages. The triangular cross-section is aerodynamically suitable for minimum frontal surface area and, most important for helicopter applications, exhibits minimum surface area coplanar with the helicopter blades, and thus minimizes rotor amplitude modulation. The triangular helix antenna with integral frequency tuning is also more efficient than previously-used antenna/antenna-coupler combinations capable of frequency hopping at high rates, and can hop at a higher rate than previous designs.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An antenna comprising:

a ground plane;

a series of coil forms mounted above said ground plane, each coil form having first and second legs disposed in triangular relation with said ground plane;

conductor means wrapped around said series of coil forms for forming a plurality of serially connected inductor coils, one inductor coil being formed on each of the first and second legs of each said coil form; and PIN diode switching means coupled to said conductor means for selectably switching at least one of a selected plurality of points on said conductor means to ground.

2. The antenna of claim 1 wherein said conductor means includes a flat conductor.

3. The antenna of claim 2 wherein said conductor means further includes a multiconductor cable, the individual conductors of said multiconductor cable being insulated from each other and insulated from said flat conductor.

4. The antenna of claim 3 wherein said pin diode switching means further includes a plurality of PIN switching diodes, each for switching a selected number of turns of said multiconductor cable to ground.

5. The antenna of claim 1 wherein said conductor means includes a multiconductor cable.

6. The antenna of claim 5 wherein said pin diode switching means further includes a plurality of PIN switching diodes, each for switching a selected number of turns of said multiconductor cable to ground.

7. An antenna comprising:

a ground plane;

a series of coil forms mounted above said ground plane, each coil form having first and second legs disposed in triangular relation with said ground plane;

conductor means wrapped around said series of coil forms for forming a plurality of serially connected inductor coils, one inductor coil being formed on each of the first and second legs of each of said coil form, said conductor means including a flat ribbon conductor and a plurality of individual conductors disposed under said flat ribbon conductor, said individual conductors being insulated from the ribbon conductor and from each other; and PIN diode switching means coupled to said conductor means for selectably switching at least one of a selected plurality of points on said conductor means to ground.

* * * * *